US010808705B2

(12) United States Patent
Albert

(10) Patent No.: US 10,808,705 B2
(45) Date of Patent: Oct. 20, 2020

(54) IMPELLER PUMP

(71) Applicant: E.G.O. Elektro-Gerätebau GmbH, Oberderdingen (DE)

(72) Inventor: Tobias Albert, Kraichtal (DE)

(73) Assignee: E.G.O. ELEKTRO-GERÄTEBAU GMBH, Oberderdingen (DE)

( * ) Notice: Subject to any disclaimer, the term of this patent is extended or adjusted under 35 U.S.C. 154(b) by 142 days.

(21) Appl. No.: 16/201,139

(22) Filed: Nov. 27, 2018

(65) Prior Publication Data

US 2019/0203725 A1 Jul. 4, 2019

(30) Foreign Application Priority Data

Dec. 1, 2017 (DE) ..... 10 2017 221 732

(51) Int. Cl.
*F04D 15/00* (2006.01)
*F04D 29/48* (2006.01)
(Continued)

(52) U.S. Cl.
CPC ..... *F04D 15/0005* (2013.01); *F04D 1/00* (2013.01); *F04D 13/08* (2013.01);
(Continued)

(58) Field of Classification Search
CPC .. F04D 15/00; F04D 15/0005; F04D 15/0011; F04D 15/0016; F04D 29/007; F04D 29/406; F04D 29/426; F04D 29/4293; F04D 29/2283; F04D 29/50; F04D 29/506; F04D 29/48; F04D 29/486
See application file for complete search history.

(56) References Cited

U.S. PATENT DOCUMENTS 4,753,570 A 6/1988 Jarvis
8,245,718 B2 8/2012 Busing et al.
2018/0291908 A1 10/2018 Blad et al.

FOREIGN PATENT DOCUMENTS

DE 302379 7/1915
DE 4418153 A1 * 11/1995 ..... F04D 29/506
(Continued)

OTHER PUBLICATIONS

German Office Action dated Nov. 16, 2018 from DE 10 2017 221 732.4, 6 pages.
(Continued)

*Primary Examiner* — Richard A Edgar
(74) *Attorney, Agent, or Firm* — Lee & Hayes, P.C.

(57) ABSTRACT

An impeller pump has a pump chamber with an inlet and an outlet, and an impeller in the pump chamber. An auxiliary outlet out of the pump chamber together with an auxiliary outlet flap is provided, the auxiliary outlet flap having a closed position and at least one open position and being rotatable or movable between the positions. In the closed position, the auxiliary outlet flap closes off the auxiliary outlet and, in each of the open positions, the auxiliary outlet flap at least partially opens the auxiliary outlet. The auxiliary outlet flap has an actuator and is subjected to force loading by the actuator, such that the auxiliary outlet flap is moved automatically from the closed position into one of the open positions if the auxiliary outlet flap is free from fluid flow in a direction of rotation of the impeller.

26 Claims, 7 Drawing Sheets

(51) Int. Cl.

| | |
|---|---|
| ***F04D 1/00*** | (2006.01) |
| ***F04D 29/42*** | (2006.01) |
| ***F04D 13/08*** | (2006.01) |
| ***F04D 29/00*** | (2006.01) |

(52) U.S. Cl.
CPC ..... *F04D 15/0016* (2013.01); *F04D 29/007* (2013.01); *F04D 29/4293* (2013.01); *F04D 29/486* (2013.01); *F05D 2250/52* (2013.01)

(56) References Cited

FOREIGN PATENT DOCUMENTS

| | | | |
|---|---|---|---|
| DE | 19932859 | A1 | 4/2000 |
| DE | 102007017271 | A1 | 10/2008 |
| FR | 2655599 | A1 | 6/1991 |
| GB | 1200197 | A | 7/1970 |
| JP | H06-249179 | A | 9/1994 |
| JP | 2010-281310 | | 12/2010 |
| WO | WO2017063970 | A1 | 4/2017 |

OTHER PUBLICATIONS

European Search Report dated Apr. 9, 2019, for European Patent Application No. 18207152.2, 9 pages.

* cited by examiner

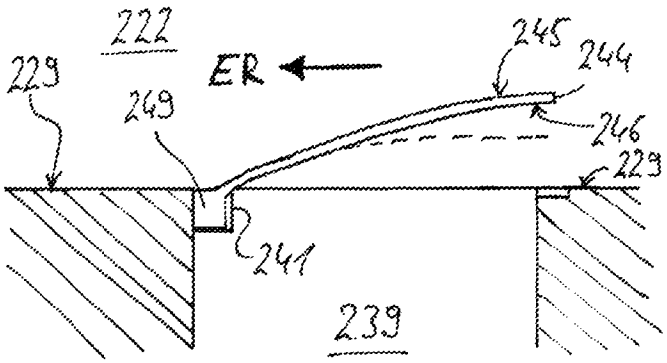
Fig.10
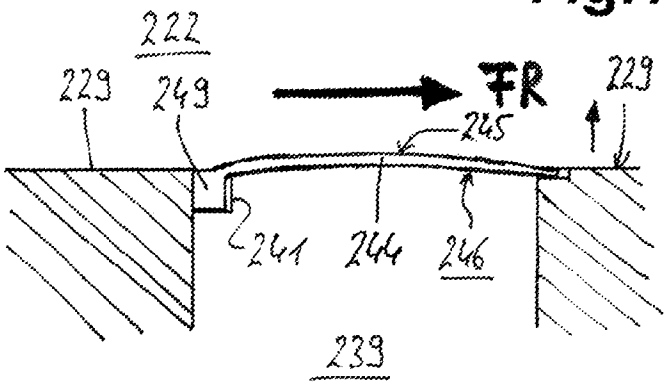
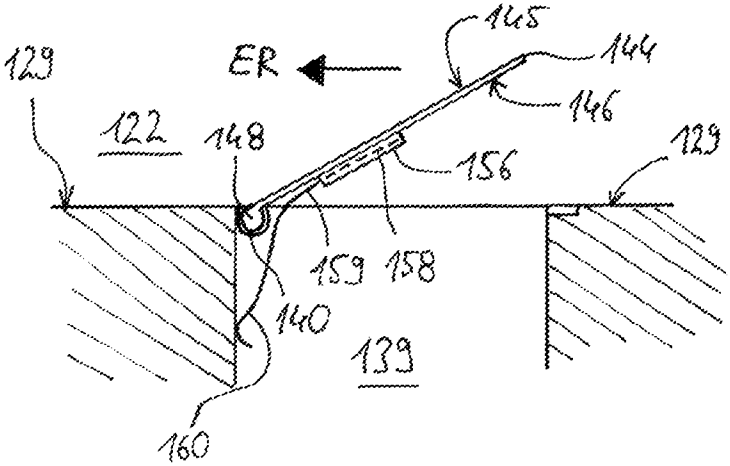
Fig.9
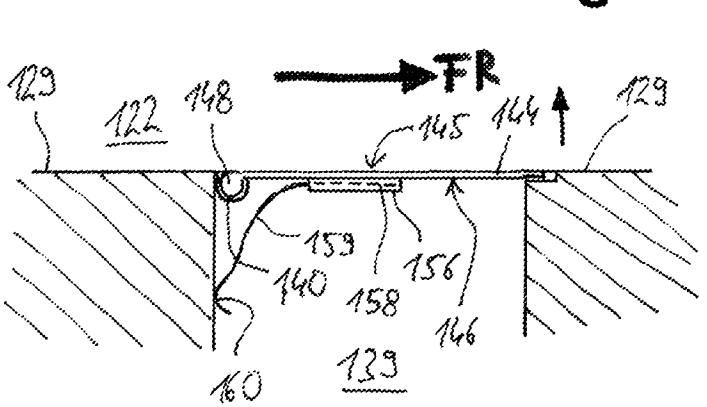

IMPELLER PUMP

CROSS-REFERENCE TO RELATED APPLICATION

This application claims the benefit of foreign priority based on German Patent Application DE 10 2017 221 732.4, filed Dec. 1, 2017, the disclosure of which is incorporated herein by reference.

FIELD OF USE AND PRIOR ART

The invention relates to an impeller pump, such as is used in particular in a water-conducting household appliance such as for example a washing machine or a dishwasher.

U.S. Pat. No. 8,245,718 B2 has disclosed an impeller pump of said type. In a housing cover of a pump chamber, in an axial direction, a central suction connector is provided as an inlet into the pump chamber. Radially outside said central suction connector, a pressure connector as an outlet out of the pump chamber is provided, which pressure connector leads away in a tangential direction from the pump chamber. A disadvantage of said impeller pump, and of further similar impeller pumps, is that the evacuation of the pump chamber commonly necessitates the use of a further, under some circumstances smaller pump. Furthermore, it is generally sought for dirty water to be pumped away, generally toward the end of the working process, out of the water-conducting household appliance into an outflow line, for which purpose a further pump is then possibly necessary.

Problem and Solution

The invention is based on the problem of creating an impeller pump as mentioned in the introduction, by means of which problems of the prior art can be solved and it is in particular possible for water to be pumped away out of a household appliance in which the impeller pump is installed, or for the pump chamber to be able to be evacuated, as simply as possible and at the same time as efficiently as possible.

Said object is achieved by means of an impeller pump having the features of claim 1. Advantageous and preferred refinements of the invention are the subject of the further claims, and will be discussed in more detail below. The wording of the claims is incorporated by express reference into the content of the description.

Provision is made whereby the impeller pump has a pump chamber, at or in which there are provided an inlet into the pump chamber and an outlet out of the pump chamber. An impeller rotates in the pump chamber, said impeller commonly being driven by a pump motor flange-mounted on or fastened to the pump. The impeller has a direction of rotation for pumping fluid from the inlet to the outlet. This is a preferred direction of rotation, wherein it is particularly preferable for blades of the impeller to be shaped or curved such that they can deliver the fluid from the inlet to the outlet in a particularly efficient manner in said direction of rotation of the impeller.

According to the invention, an auxiliary outlet out of the pump chamber is provided, together with an auxiliary outlet flap at or for said auxiliary outlet. The auxiliary outlet flap has a closed position and at least one open position. Said auxiliary outlet flap is formed so as to be movable, advantageously rotatable, or alternatively bendable, between said two positions. Said auxiliary outlet flap is advantageously formed here so as to be rotatable about an axis, that is to say is formed so as to be rotatably mounted and not merely elastically movable and deflectable, for example by bending or twisting. In the closed position, the auxiliary outlet flap closes off the auxiliary outlet, advantageously substantially or even entirely. For this purpose, the auxiliary outlet flap may be of approximately equal size to, advantageously slightly larger than, the auxiliary outlet. In each of the open positions, the auxiliary outlet is at least partially open, or the auxiliary outlet flap at least partially opens up or opens said auxiliary outlet. The auxiliary outlet can thus be open to a greater or lesser extent depending on the open position.

Additionally, an actuating means is provided, whereby the auxiliary outlet flap is subjected to force loading such that said auxiliary outlet flap is automatically moved from the closed position into one of the open positions if no fluid or water is being pumped from the inlet to the outlet or if the auxiliary outlet flap is free from fluid flow in the direction of rotation of the impeller for pumping the fluid during normal operation. The actuating means can thus move the auxiliary outlet flap at least into the first open position or into the open position with the minimum degree of opening. Under some circumstances, it may thus suffice for the actuating means to open the auxiliary outlet flap only to a small extent.

It can thus be achieved that, in the closed position, no fluid escapes through the auxiliary outlet, or is delivered out of the pump chamber, during pumping. Ultimately, it is indeed normally the intention for the fluid to be delivered from the inlet to the outlet. The fluid flow may in this case even assist in holding the auxiliary outlet flap in the closed position, because said fluid flow for example pushes said auxiliary outlet flap down. In the absence of a fluid flow, it is the intention that the auxiliary outlet flap automatically at least partially opens. Then, by reversal of the direction of rotation of the impeller, as will be discussed in more detail below, it is possible to effect a delivery into the at least partially open auxiliary outlet flap or past the latter into the then at least partially open auxiliary outlet, and thus for fluid to be brought to a different outlet of the impeller pump, preferably toward an outflow line.

By means of the specific design of the auxiliary outlet flap together with actuating means, which are advantageously passive actuating means, with the automatic opening, it is possible to dispense with actuators that have to be specially activated, such as electromagnets, piezo drives or electric motors. This considerably simplifies the construction of the impeller pump and the operation thereof. Furthermore, structural space can also be saved.

In one refinement of the invention, provision may be made whereby the auxiliary outlet flap can be moved by the actuating means into that open position from the group of multiple open positions which has the maximum degree of opening and/or in which said auxiliary outlet flap is at the maximum distance from the closed position. It can thus be achieved that the auxiliary outlet flap has the closed position. Starting at this closed position, a movement may be provided for opening, during which movement the auxiliary outlet flap is firstly opened slightly, for example after a rotation through only a few degrees of bend angle. The actuating means however seeks to open the auxiliary outlet flap yet further, in particular to open it to the maximum extent. Then, even in the event of a reversal of the direction of rotation of the impeller, the greatest possible amount of fluid or water can be pumped to the auxiliary outlet out of the pump chamber. For this open position with the maximum degree of opening, it may be the case that, for this purpose, the auxiliary outlet flap has rotated through an angle of 10° to 45°, preferably 15° to 30°. If, in the case of the opposite main direction of rotation of the impeller, that is to say if its direction of rotation has been reversed, the fluid flows toward the open auxiliary outlet flap and through the auxiliary outlet, then a particularly high efficiency can be achieved by means of the auxiliary outlet flap. Said auxiliary outlet flap thus not only closes off the auxiliary outlet in the closed position but also, in the open positions, in particular in the open position with the maximum degree of opening, conducts the fluid into the auxiliary outlet with the greatest possible effectiveness in the case of the reversed direction of rotation of the impeller.

For the embodiment of the actuating means, there are several possibilities. They are advantageously of resilient form or have spring means as actuating means in order to subject the auxiliary outlet flap to force loading in order that it moves out of the closed position. The spring means should be installed such that they pose the least possible obstruction to a fluid flow.

As spring means, use may on the one hand advantageously be made of plastics spring means. These have the advantage that they do not corrode when in permanent contact with water. Such spring means may advantageously have a voluminous block body which may particularly advantageously have a cylindrical form. It is thus possible for the spring means to have, for example, the form of a cuboid and to be composed of elastic material, in particular specifically plastic. As plastic, silicone is expedient here, and under some circumstances also rubber.

As an alternative to a plastics spring means, use may on the other hand be made of a conventional spring, that is to say for example a leaf spring, a helical spring, a spiral spring or a combined helical-spiral spring. It is thus possible, for example, for a spring to also be wound around an axis of rotation and to build up a torque by twisting or torsion, which torque then specifically seeks to open the auxiliary outlet flap.

As a yet further alternative, the auxiliary outlet flap itself may be of soft or elastic form or be composed of such an elastic material, in particular an elastomer, that it itself forms the actuating means or the spring means by which it is opened. Then, as it were, the spring or the spring action is integrated into the auxiliary outlet flap. In a normal position in the absence of fluid flow, said auxiliary outlet flap may be slightly open, that is to say in a relatively slightly opened open position. Depending on the flow direction, said auxiliary outlet flap is then pushed open further or pushed closed further, or pushed into the closed position, that is to say closes off the auxiliary outlet.

In one refinement of the invention, the pump may have sealing means at the auxiliary outlet and/or at the auxiliary outlet flap. Said sealing means are advantageously formed in an encircling manner around the auxiliary outlet, but at least along one side, for example close to the impeller. The auxiliary outlet flap can thus be held relatively easily. Provision may be made for a sealing means to be injection-molded onto the pump housing, for which purpose a multi-component injection-molding process is particularly advantageously suitable. This is advantageous in particular if the sealing means is a type of sealing lip, round cord seal or the like. Specifically, the sealing means may also have a sealing rubber which, by way of its elasticity, ensures a sealing action in the closed position. Said sealing means may also be formed by means of the abovementioned embodiment of the auxiliary outlet flap composed of elastic material, such that the flap itself also imparts an adequate sealing action by way of its soft material.

As an alternative to a sealing means composed of elastic material, it is also possible for a labyrinth seal to be provided between auxiliary outlet flap and the edge of the auxiliary outlet at which, or close to which, the flap runs. Such a labyrinth seal may have a stepped profile of a sealing surface between auxiliary outlet and auxiliary outlet flap, for example with one to three angular steps. Then, it may be the case that a sealing action is not quite as good as in the case of an elastic rubber seal, but said sealing action is sufficient for the operation of the impeller pump.

Provision is advantageously made whereby the auxiliary outlet flap, in the closed position, has the least possible adverse effect on the operation of the pump and on an efficiency of the pump. Said auxiliary flap should also constitute the least possible additional flow resistance, or at best no additional flow resistance whatsoever, when the impeller pumps fluid from the inlet to the outlet of the pump chamber. Then, said auxiliary flap is thus advantageously, as it were, not even present. For this purpose, provision may advantageously be made whereby the auxiliary outlet flap, in the closed position, forms an as far as possible continuous continuation, in particular in exactly continuous continuation, of the profile of the pump chamber or of a wall of the pump chamber in said region around the flap. The profile of the pump chamber or of the wall of the pump chamber should be continued in a continuous manner, wherein in particular also roundings and/or archings corresponding to that region of the pump chamber which surrounds the auxiliary outlet determine the design of the auxiliary outlet flap at least at the outer side thereof. If the surrounding region of the pump chamber is flat, then the outlet flap may also be of flat form at the outer side. Thus, in the closed position, the pump chamber, in particular its wall, should have a form as if the auxiliary outlet flap were not even present.

In a yet further refinement of the invention, provision may be made whereby the auxiliary outlet flap has an inner side which, in the closed position, points toward the auxiliary outlet or points into the auxiliary outlet. Said auxiliary outlet flap thus points away from the pump chamber, whereas the abovementioned outer side of the auxiliary outlet flap covers the auxiliary outlet in particular in the closed position, or is the surface along and past which the fluid flows as it is pumped from the inlet to the outlet. The inner side may advantageously be convexly arched, specifically arched convexly away from the auxiliary outlet or toward the pump chamber. By means of this specific form, it is sought to achieve that, in the open position of the auxiliary outlet flap, or in the open position with the maximum degree of opening, the fluid that flows through the opened auxiliary outlet flap into the auxiliary outlet in the case of the reversed direction of rotation of the impeller flows into the auxiliary outlet as quickly and efficiently as possible. By means of this arching, it is thus the intention for the pumped fluid to be as effectively as possible intercepted, as it were, and conducted into the auxiliary outlet.

On the inner side of the auxiliary outlet flap, there may advantageously be provided a lateral wall which has an angle of between 60° and 120° with respect to the outer side. If the outer side is flat or substantially flat, said angle may also lie between 80° and 100°. It may particularly advantageously amount to 90° or slightly less.

Provision may also be made for said lateral wall to never be moved entirely out of the opening of the auxiliary outlet during the operation of the pump.

For this purpose, a stop may be provided, advantageously on the lateral wall itself, which stop can abut against an inner edge of the auxiliary outlet. The lateral wall may preferably have a longitudinal outer edge which, in the open position with the maximum degree of opening, runs, over a major part of its length in a direction away from the axis of rotation of the auxiliary outlet flap, in particular over its entire length, within the auxiliary outlet. In this way, it is firstly possible to realize a certain guidance of the auxiliary outlet flap, or support in the open positions and in particular also in the open position with the maximum degree of opening. This prevents damage to the auxiliary outlet flap and also already bending or deformation if it is the intention for fluid to be pumped from the inlet into the pump chamber to the auxiliary outlet by the impeller counter to its main direction of rotation. Secondly, it can thus be achieved that, in this region, no fluid can escape, as it were, between lateral wall and auxiliary outlet and flow past the auxiliary outlet.

On the lateral wall, there may be provided a projection or the like for the abovementioned stop, in particular at the stated free longitudinal outer edge of the lateral wall, particularly preferably as far remote as possible from the axis of rotation of the auxiliary outlet flap, which specifically forms the stop on the pump housing or on the wall of the pump chamber. In this way, the open position with maximum degree of opening is exactly limited. It is thus possible for too wide an opening to be avoided, which would possibly no longer be expedient from a flow aspect. Likewise, a breakaway of the auxiliary outlet flap can be prevented.

Provision may advantageously be made for the lateral wall to run parallel to an encircling outer wall of the pump chamber. The lateral wall may thus also be curved in its longitudinal profile away from the axis of rotation of the auxiliary outlet flap.

In an open position with the maximum degree of opening of the auxiliary outlet flap, preferably in each open position, the lateral wall may run with a spacing of between 0.5 cm and 2 cm to an encircling outer wall of the pump chamber. This means that the lateral wall may have a relatively small spacing to the outer wall of the pump chamber, but said spacing does indeed exist. This is advantageous in particular if the impeller pump has a heated outer wall of the pump chamber. Furthermore, the auxiliary outlet flap must indeed still be integrated in the existing structural space in the pump chamber.

In a preferred refinement of the invention, the pump chamber runs in ring-shaped fashion around the impeller. The auxiliary outlet may in this case be arranged in a ring-shaped end surface of the pump chamber in an axial direction along the axis of rotation of the impeller. This may be a base surface or a top surface of the pump chamber. Such an end surface is advantageously arranged so as to run approximately in a plane of one of the two cover surfaces of the impeller. Provision may particularly advantageously be made for said end surface to be remote from the outlet out of the pump chamber, see US 2016/169320 A1. It can thus be achieved that the fluid flow when fluid is pumped out of the outlet behaves very differently than in the case of pumping out of the auxiliary outlet. The provision of the auxiliary outlet flap at one of said end surfaces of the pump chamber and not at a radially outer wall of the pump chamber has the advantage that said wall can therefore be of closed form, for example composed of metal with externally situated heating conductors.

The arrangement of the auxiliary outlet in an end surface of the pump chamber which runs in a plane of one of the two cover surfaces of the impeller has the advantage that, when fluid is pumped with the direction of rotation of the impeller for pumping out of the auxiliary outlet, the fluid that flows out between the two cover surfaces of the impeller can flow relatively directly to the auxiliary outlet. If provision is then made whereby, in the open position with the maximum degree of opening, the auxiliary outlet flap lies close to the impeller, in particular in a radial direction, for example with a radial spacing of at most 1 cm, then it is likewise possible for fluid to be pumped out to the auxiliary outlet in as effective a manner as possible.

In a further refinement of the invention, it may be possible for an abovementioned inner side of the auxiliary outlet flap to be approximately at the axial level of and radially outside the other top surface of the impeller, specifically such that fluid flows out of the impeller directly outward in a radial direction into the auxiliary outlet flap and thus into the auxiliary outlet. Thus, a type of flow channel for the fluid forms between that end surface of the pump chamber in which the auxiliary outlet flap is provided and the auxiliary outlet flap itself, or the above-described inner side thereof. Said two surfaces may then approximately correspond to the plane in which the abovementioned cover surfaces of the impeller run, whereby pumping fluid out of the auxiliary outlet can take place in as effective a manner as possible.

In one refinement of the invention, the auxiliary outlet may lead out of the pump chamber in a radial direction or in a plane perpendicular to an axis of rotation of the impeller. The auxiliary outlet then advantageously also leads out of an entire housing of the impeller pump, for example at a pipe connector, which is highly suitable for the connection of water lines or hoses, in particular elastic hoses.

In general, provision may be made whereby the auxiliary outlet flap is held down, and is thus held in the closed position, by the pumped fluid while the impeller rotates in the main direction of rotation, such that the auxiliary outlet is closed preferably only by the pumped fluid. It is thus achieved that, after the impeller stops rotating, or in the presence of low rotational speeds and thus a small fluid flow, the abovementioned actuating means pushes the auxiliary outlet flap from the closed position into an opened position as the fluid is pumped. The actuating means may advantageously seek to push the auxiliary outlet flap into the open position with the maximum degree of opening, wherein this need not be the case. Even the opening of the auxiliary outlet flap with a small opening travel can be regarded as sufficient, specifically if the fluid moved by the impeller in the other direction of rotation then fully opens the auxiliary outlet flap or pushes said auxiliary outlet flap into the position with the maximum degree of opening. The spring means may thus, in this case, serve to provide a certain open position with a relatively small degree of opening. The complete opening of the auxiliary outlet flap is then effected by the flow of the fluid in the pumping direction for pumping out of the pump.

These and further features will emerge not only from the claims but also from the description and the drawings, wherein the individual features may each be realized individually or severally in the form of sub-combinations in an embodiment of the invention and in other fields and constitute advantageous and independently protectable embodiments, for which protection is claimed here. The division of the application into individual sections and intermediate subheadings does not mean that the statements made under these are restricted in terms of their general applicability.

BRIEF DESCRIPTION OF THE DRAWINGS

Embodiments of the invention are schematically illustrated in the drawings and will be discussed in more detail below. In the drawings:

FIG. 9 shows an exemplary embodiment of an auxiliary outlet flap illustrated in simplified form, with a separate spring means, in a pump chamber in the base surface and FIG. 10 shows an exemplary embodiment of an auxiliary outlet flap illustrated in simplified form, which is itself of resilient form, in a pump chamber in the base surface.

DETAILED DESCRIPTION OF THE EXEMPLARY EMBODIMENTS

Figure 1:
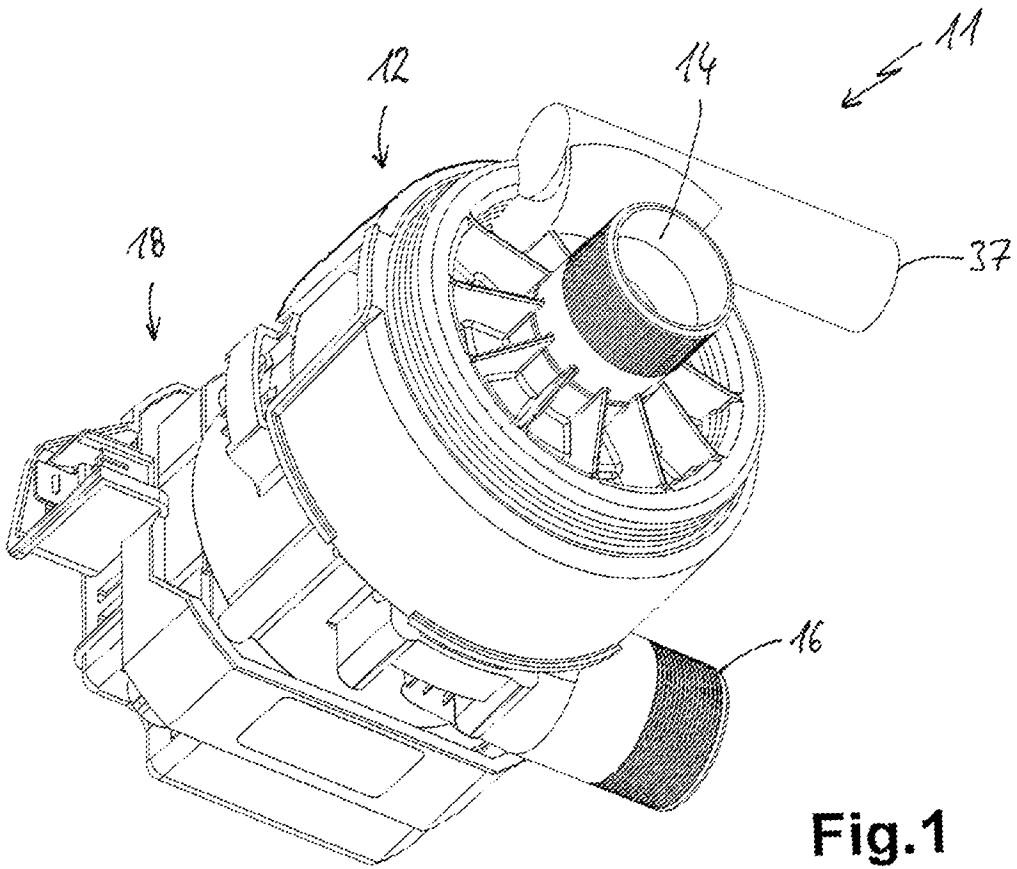
FIG. 1 shows an oblique view of an impeller pump according to the invention in the closed state.

FIG. 1 shows an impeller pump according to the invention as pump 11 in an oblique illustration, such as corresponds technically and in terms of construction substantially to a pump corresponding to the above-cited US 2016/169320 A1. The pump 11 has a pump housing 12 together with axial inlet 14 and radial outlet 16. Connected to the pump housing 12 at the rear is a drive part 18, which comprises in particular a drive motor. In this regard, too, reference is made to the above-cited prior art. Furthermore, an auxiliary outlet 37 is provided at the front on the pump housing 12, directly adjacent to the inlet 14. The extent direction of said auxiliary outlet is approximately parallel to that of the outlet 16, though this need not be the case. The auxiliary outlet 37 is a short pipe, on the end of which there may be provided various attachment facilities for further lines such as pipes or hoses. This does not need to be explained in more detail here to a person skilled in the art.

Figure 2:
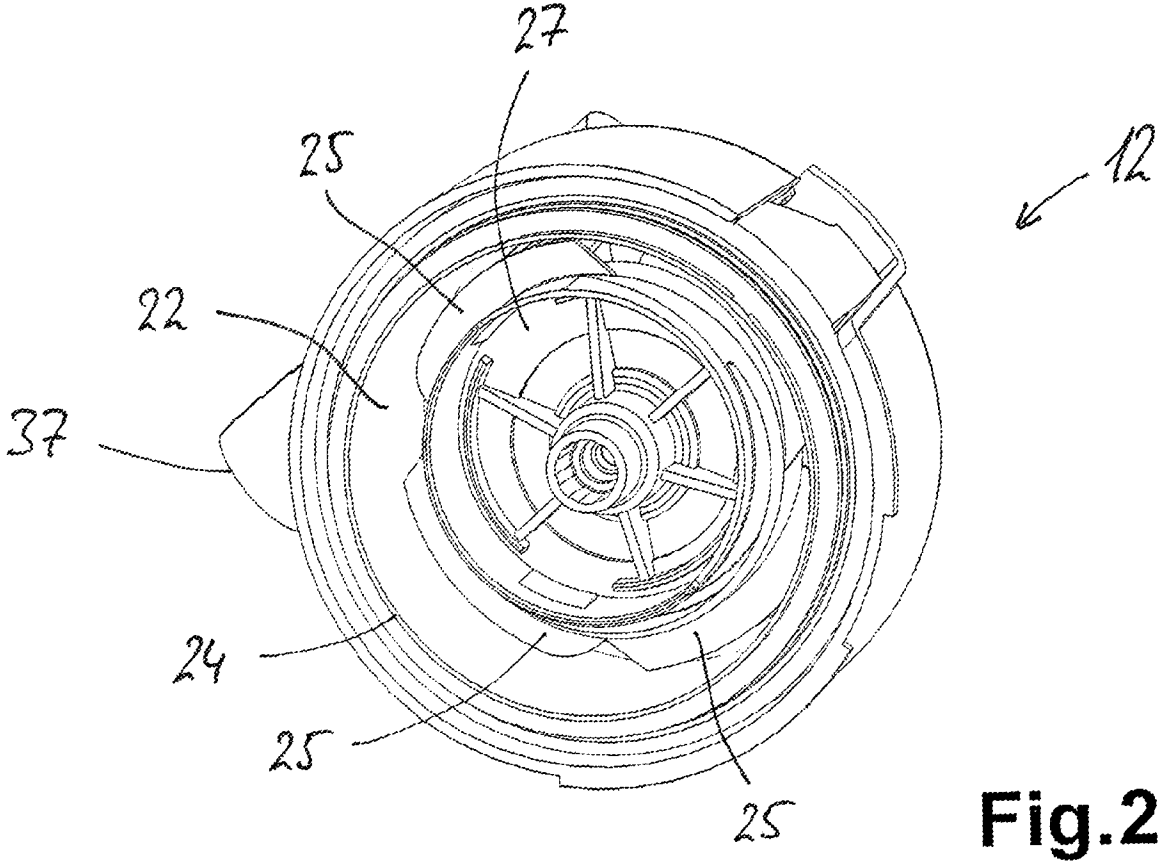
FIG. 2 shows a view into a pump housing of the impeller pump from FIG. 1 as seen from a drive part.

FIG. 2 illustrates a view into a pump chamber 22, illustrated from the viewing direction of the remote drive part 18. On the left-hand side, it is possible to see the auxiliary outlet 37 out of the pump chamber 22. In the pump chamber 22, a chamber wall 24 is illustrated as a circularly encircling and closed ring, advantageously composed of metal with externally situated heating conductors or heating elements. This, too, is known in the above-cited prior art. Guide blades 25 are illustrated within the chamber wall 24. Said guide blades are attached or integrally formed at the outside on a drive receptacle 27, into which, in particular, an abovementioned drive motor may project. The impeller and also the auxiliary outlet are provided below the drive receptacle 27 into the plane of the drawing.

Figure 3:
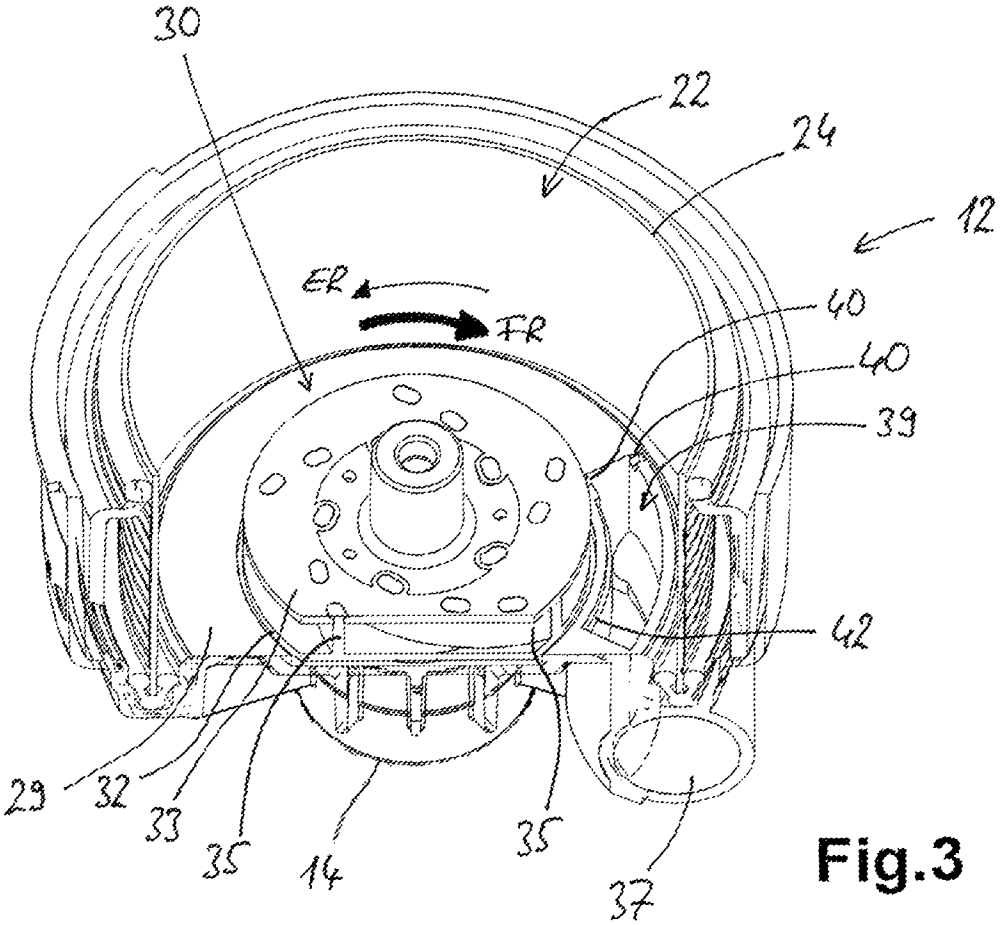
FIG. 3 shows a partially sectional oblique view into a pump chamber with chamber wall and base surface, over which an impeller rotates, and with an interposed auxiliary outlet opening without flap.

The construction can be seen more clearly from FIG. 3 with the partially sectional oblique illustration. Here, the drive receptacle 27 of FIG. 2 has also been removed, and it can be clearly seen that, within the lower or front end of the chamber wall 24, there is provided an encircling base surface 29. Said base surface 29 runs substantially in a plane or is flat and may be approximately at right angles to the chamber wall 24, though this self-evidently need not be the case. The ring-shaped base surface 29 surrounds, as it were, an impeller 30, or said impeller is, as will be discussed in more detail further below, arranged so as to be slightly recessed in a central depression in the base surface 29.

The impeller 30 has a base disk 32 and a cover disk 33 as cover surfaces. Later, in FIG. 8, it will be seen that said base disk 32 runs substantially in recessed fashion in the base surface 29, such that the top side of said base disk protrudes only slightly above the plane of the base surface 29. Five curved impeller blades 35 run between base disk 32 and cover disk 33.

During the normal operation of the pump 11 for delivering fluid, which enters through the inlet 14 out to the outlet 16, the impeller 30 rotates to the right, or clockwise, in the delivery direction FR illustrated by means of a thick arrow. The delivered fluid or water then rotates or revolves in said direction within the chamber wall 24, and may possibly be heated. Then, at an end region remote from the base surface 29, said fluid or water emerges from the pump chamber 22 again in a tangential direction, specifically through the outlet 16.

If the impeller 30 is driven in the opposite direction, specifically in the evacuation direction ER, which is illustrated by a thin arrow, then the fluid that can flow into the inlet 14 is as far as possible not delivered out to the outlet 16. Rather, it is the intention that said fluid then be delivered out of the pump chamber 22 through an auxiliary outlet opening 39 to the auxiliary outlet 37. Here, the auxiliary outlet 37 may lead to a wastewater line or to a wastewater hose out of a water-conducting household appliance in which the pump 11 is installed, and from there to a drain or a drain line in the house.

In the illustration of FIG. 3 without a flap, it can be seen that the auxiliary outlet opening 39 has an elongate form and is curved. The curve thereof corresponds exactly to the profile of the impeller 30 radially to the inside thereof and of the chamber wall 24 radially to the outside thereof, that is to say the longitudinal edges of said auxiliary outlet opening are, as it were, parallel to both. The length of said auxiliary outlet opening is approximately 3 to 4 times as great as its width. At one end, specifically the end of the rear in FIG. 3, the auxiliary outlet opening 39 has two axle bearing depressions 40. These serve for the articulated mounting of the flap. Furthermore, along the radially inner edge or the radially inner longitudinal side, there is provided a stepped edge 42. This need not be provided at the radially outer edge. The transition from the auxiliary outlet opening 39 to the auxiliary outlet connector 37 therebelow is not illustrated in detail, but should be of as far as possible fluidically optimum shape.

Although only a single auxiliary outlet opening 39 is illustrated here, it would nevertheless also be possible for there to be several, for example two or three. Instead of in each case one single auxiliary outlet connector, said auxiliary outlet openings could then lead in each case into a ring-shaped space which, as it were, adjoins the base surface 29 from the front. Then, a single connector may be led out of said ring-shaped space, such that an attachment is more easily possible.

Figure 4:
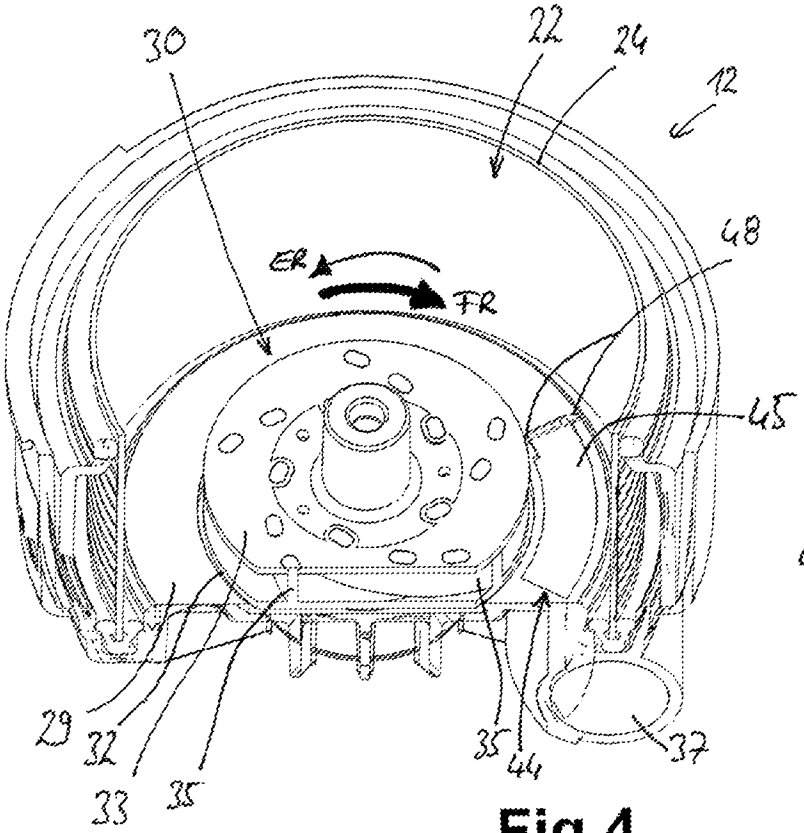
FIG. 4 shows the view from FIG. 3 with inserted auxiliary outlet flap in a closed position.

FIG. 4 illustrates how the auxiliary outlet opening 39 is closed off by means of an auxiliary outlet flap 44. The auxiliary outlet flap 44 closes off, or closes, the auxiliary outlet opening 39 in a very closely fitting manner, such that only a thin edge is visible. Furthermore, said connection is thus in fact already adequately leak-tight. In the radially inner region, the stepped edge 42 is provided as an additional sealing means or as a type of simple labyrinth seal, as has been mentioned in the introduction. It would also be possible in a highly effective manner for an elastic sealing material or a sealing rubber to be provided at said stepped edge 42, for example also by injection molding. Alternatively, such a separate seal composed of elastic material or conventional seal material could also be provided on a corresponding edge or on a side of a flap. Finally, it would also be possible for the auxiliary outlet flap 44 to itself be composed of material of similar elasticity to a seal, and thus itself impart the sealing function.

The auxiliary outlet flap 44 has an outer side 45, which is a continuation of the surfaces, surrounding it, of the pump chamber 22. Since the auxiliary outlet opening 39 is situated entirely within the planar ring-shaped base surface 29, said outer side 45 is likewise planar and does not protrude beyond said base surface 29. Since, here, the chamber wall 24 is a separate, dedicated component and is composed in particular of metal owing to the heating conductors attached to the outside, an integration of the auxiliary outlet flap 44 into the fillet or into the transition region between base surface 29 and chamber wall 24 is not possible. This would however theoretically be conceivable and also easily implementable.

The mounting of the auxiliary outlet flap 44 at the auxiliary outlet opening 39 is realized by means of two integrally formed short axle stubs 48, which lie in the axle bearing depressions 40. Under some circumstances, said axle stubs may be held therein by detent means, for example by means of axle bearing depressions which extend over more than 180°, such that it is not possible for said axle stubs to jump out of their own accord and for the auxiliary outlet flap 44 to possibly be lost.

As shown by the delivery direction FR, during the normal delivery of fluid in the clockwise rotational direction, the fluid emerging from the impeller 30 flows over the auxiliary outlet flap 44 such that the latter, or the outer side 45 thereof, is pushed downward, whereby the auxiliary outlet opening is closed. This closure is duly not imperatively absolutely water-tight, in particular if fluid pressure were to prevail. This is however also not necessary during normal operation for the delivery of fluid, because the fluid emerging from the impeller 30 indeed circulates a few times within the pump chamber 22 in a clockwise rotational movement before emerging again to the outlet 16.

Figure 5:
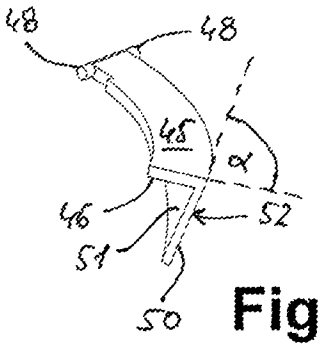
FIGS. 5 and 6 show two different views of the auxiliary outlet flap from FIG. 4.
Figure 6:
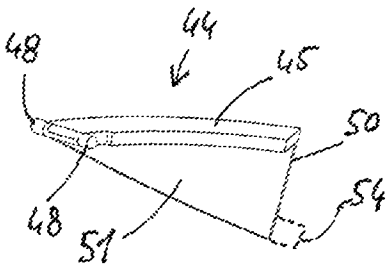

FIGS. 5 and 6 illustrate the auxiliary outlet flap 44 in detail, on the one hand from the front and above and on the other hand from the side and above. It can be seen that the auxiliary outlet flap has an inner side 46 situated opposite the outer side 45. At the rear end, the two abovementioned axle stubs 48 are integrally formed. At the outer side, a lateral wall 50 is provided and is connected integrally to, or is produced in one piece with, the areal flap. This lateral wall 50 which runs in curved fashion has an inner surface 51 and an outer surface 52. It can be seen that the lateral wall 50 is at an angle $\alpha$ of approximately 80° with respect to the outer surface 52. This has the advantage, as will be seen below from FIG. 7, that said lateral wall then, as it were, remains within the radially outer outside edge of the outer side 45 during the pivoting, and thus does not impede free mobility, because the axis of rotation of the auxiliary outlet flap is parallel to the outer side 45. The primary purpose of said lateral wall 52 is to, as it were, intercept the fluid emerging from the impeller 30 in a radial direction or with a large radial directional component, and to divert said fluid downward into the auxiliary outlet opening 39, as shown in FIG. 7.

At the front and at the bottom on the lateral wall 50, an optionally provided projection 54 is shown in a dashed-line illustration. Said projection may engage under a front edge of the auxiliary outlet opening 39 during the pivoting-open or during the upward pivoting of the auxiliary outlet flap 44, that is to say toward the open position with the maximum degree of opening. Said open position with the maximum degree of opening can be defined or attained by abutment of said projection 54 below the base surface 29. Since the projection 54 is in this case not arranged within the direct fluid flow, it also does not cause any fluidic disruption. Furthermore, the lateral wall 50 is always within the auxiliary outlet opening 39, for a good introduction of the fluid into the latter.

As actuating means according to the invention for the opening of the auxiliary outlet flap 44 with pivoting about the axis of rotation by means of the axle stubs 48, various spring means could be provided, for example known torsion springs in the manner of a helical spring with one or two turns and with very long free limbs. These could be supported at one side on the inner side 46 and at the other side at the bottom below the auxiliary outlet opening 39. It would likewise be possible for a block-like body composed of resilient plastic or foamed material, as mentioned in the introduction, to be provided at the left-hand edge of the auxiliary outlet flap 44, for example in the region toward the stepped edge 42. This could likewise be provided at the bottom edge of the lateral wall 50, where this runs in the closed position as per FIG. 4. In the case of such actuating means, it could also suffice for the auxiliary outlet flap 44 to only be open slightly, for example by a few degrees rotational angle or by a few millimeters at the front end, opposite the end with the axle stubs 48. If the fluid flow then revolves in the direction of revolution ER, then said fluid flow can, as it were, engage under the slightly open auxiliary outlet flap 44 and fully pull or push said auxiliary outlet flap open.

Figure 7:
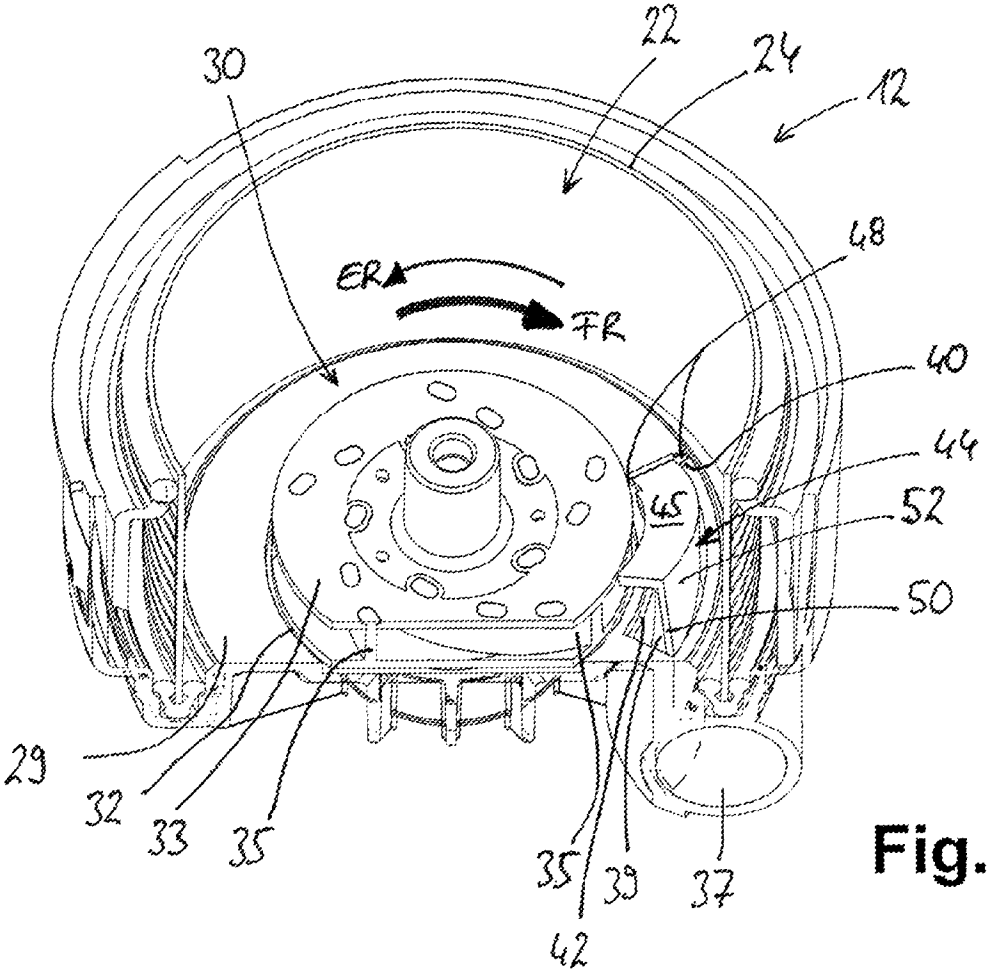
FIG. 7 shows the illustration of FIG. 4 with the auxiliary outlet flap in the open position with the maximum degree of opening.
Figure 8:
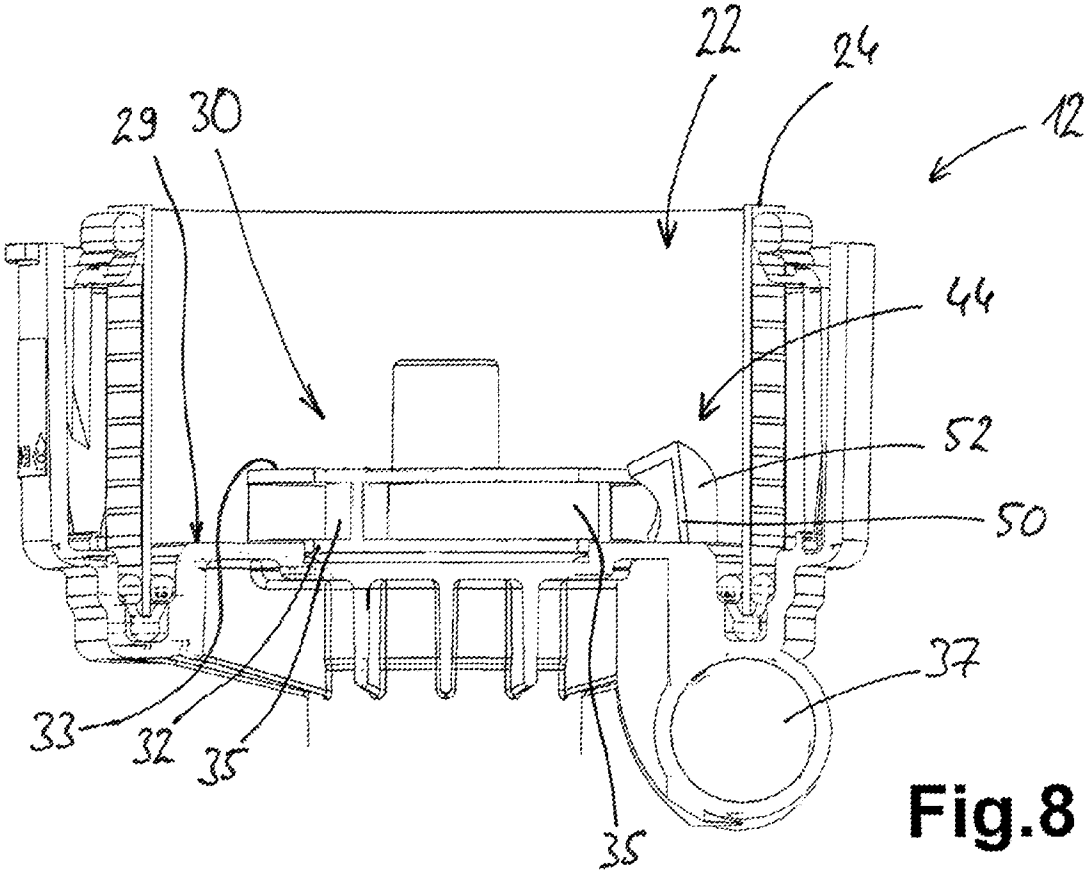
FIG. 8 shows the illustration of FIG. 7 rotated in a side view.

The illustration of FIGS. 7 and 8 shows the open position of the auxiliary outlet flap 44 with the maximum degree of opening. It can be seen that said auxiliary outlet flap is open to such an extent that the inner side 46 even lies slightly above the plane of the underside of the cover disk 33, as a result of which fluid delivered or centrifuged out of the impeller 30 in a radial direction or at least in a partially radial direction is, in said region, centrifuged directly against said inner side 46 and the inner surface 51 of the lateral wall 50. Thus, in this region, fluid is intercepted in a particularly effective manner and delivered through the auxiliary outlet opening 39 to the auxiliary outlet connector 37, that is to say out of the pump 11.

Furthermore, it is however also the case that fluid revolving in the direction of revolution ER is intercepted from said revolution, as it were, by the auxiliary outlet flap 44 and conducted out to the auxiliary outlet connector 37. The provision of multiple such auxiliary outlet flaps in the pump chamber 22 could self-evidently intensify this effect, such that pumping-out or evacuation could take place even more quickly. At the same time, this self-evidently entails greater outlet in terms of construction, and a greater number of possible failure points in the case of material fracture or problems.

In FIG. 8, it can also be seen that the radial spacing between the auxiliary outlet flap 44 or the lateral wall 5 thereof together with outer surface is in this case very large. It would thus be possible for the fluid forced outward by centrifugal force owing to the revolution in the pump chamber 22 to relatively commonly run past the auxiliary outlet flap 44 also during the evacuation, which would somewhat impede a complete evacuation. In the specific exemplary embodiment, it can however be seen that, owing to the arrangement of the chamber wall 24 of the pump chamber 22 together with complex seal in the lower region, a certain spacing of the base surface 29 in a radial direction is necessary, and therefore no widening or relocation of the auxiliary outlet flap 44 further outward toward the chamber wall 24 is possible. In the case of other constructions of pumps according to the invention, this is however possible, and could then also be provided.

The convex arching, mentioned in the introduction, of the auxiliary outlet flap 44 at its inner side 46 is formed by the angle $\alpha$ between the surface or the outer side 45 and the lateral wall 50, wherein here, $\alpha$=approximately 80°. Specifically in the inner region between inner side 46 and inner surface 51, it would be possible for a rounding or a fillet to be provided. This could offer advantages in terms of flow, though need not be provided.

The spacing in a radial direction between the impeller 30 and the auxiliary outlet flap 44, or the rounded radial inner edge thereof, is relatively small, as shown in FIGS. 4 and 7. Said spacing is for example 1 mm to 3 mm, specifically exactly such that adequate stability of the base surface 29 remains ensured in this region too.

FIG. 9 shows, in an exemplary embodiment, the arrangement of an auxiliary outlet flap 144, illustrated in simplified form, in a pump chamber 122 or within the base surface 129. The auxiliary outlet flap 144 is, at the left-hand end, mounted rotatably in an axle bearing depression 140 by means of corresponding axle stubs 148. The auxiliary outlet flap 144, which in this case is of flat form, has an outer side 145, which is advantageously flat and smooth, as in the preceding exemplary embodiment, so as to pose little resistance to water. At an inner side 146, there is provided a spring receptacle 156, which has for example 50% of the width of the auxiliary outlet flap 144 and is arranged centrally. The spring receptacle 156 has a wide and flat slot, which is open at least at the lower end and into which a leaf spring 159, as actuating means according to the invention, is inserted with an upper spring end 158. Said upper spring end 158, which is illustrated here by dashed lines, could, in a known manner, have one or more punched-out serrations or elevations, by means of which said upper spring end, after being inserted, is fixedly held in the spring receptacle 156 and can no longer be pulled out or no longer emerges of its own accord. The leaf spring 159 is advantageously composed of a rust-resistant high-grade steel or spring steel, for example with approximately one third of the width of the auxiliary outlet flap 144. Said leaf spring may alternatively be composed of plastic. Its spring force may be relatively low. In a central region, said leaf spring is slightly curved, and by way of a lower spring end 160, which in its entirety is bent somewhat more intensely once again at the end, the leaf spring 159 lies against a wall of the auxiliary outlet opening 139, or is supported against said wall.

It can be easily seen that, in the open position illustrated at the top in FIG. 9, the fluid flow with the direction of revolution ER prevails, that is to say it is important that the auxiliary outlet flap 144 is open. Said auxiliary outlet flap has, according to the invention, been pushed open by the spring force of the leaf spring 159. Said spring force is illustrated in FIG. 9 in the lower illustration, in which the auxiliary outlet flap 144 is in the closed position, as an upward arrow at the free end of the flap. Here, the much more intense fluid flow with the direction of revolution FR prevails. An opening of the auxiliary outlet flap 144 to an even greater degree or to an excessive degree may, as discussed above, be prevented by means of a projection corresponding to FIG. 6, which for the sake of clarity is not illustrated here.

From a comparison of the illustrations in FIG. 9 at the bottom and at the top, it can be easily seen that, with corresponding bending of the leaf spring 159, the latter seeks to push the auxiliary outlet flap 144 upward. This is also easily possible if no fluid flow currently prevails in the pump chamber 122, or a fluid flow with the direction of revolution ER, as illustrated above, prevails. If, as in FIG. 9 at the bottom, the fluid flow with the direction of revolution FR for the delivery in accordance with the normal pump function prevails, then the auxiliary outlet flap 144 is also pushed counter to the spring force of the leaf spring 159 into the closed position illustrated there. Then, the base surface 129 is closed off or closed in a relatively leak-tight manner.

It does not constitute a significant problem to configure the spring force of the leaf spring 159 correspondingly. For this purpose, correspondingly thin material may be provided for the leaf spring 159; alternatively, lateral incisions or the like may also be provided.

A fastening of the leaf spring 159 is considered to be advantageous, particularly advantageously specifically by insertion upward into the spring receptacle 156. In a modification of the illustration in FIG. 9, said leaf spring could also be fastened to the left-hand inner wall of the auxiliary outlet opening 139, for example with a similarly designed spring receptacle, and then be supported by means of a free end on the inner side 146 of the auxiliary outlet flap 144, and possibly slide along on said inner side to certain extent.

In a yet further embodiment not illustrated here, it would be possible for a helical spring composed of spring wire with long projecting limbs to be arranged as actuating means around an axis corresponding to the axle stubs 148, which helical spring pushes the auxiliary outlet flap 144 open and, here, is supported on the same inner wall of the auxiliary outlet opening 139. Then, specifically such a spring, the type of construction of which is fundamentally known, for pushing open or pushing closed by means of a torque would be fastened to said axle stubs or to a corresponding rotary axle.

A yet further embodiment is illustrated in FIG. 10, in which an auxiliary outlet flap 244 is not mounted rotatably about a defined axis of rotation by means of axle stubs, but rather is arranged, by means of a bearing end 249 of rectangular form, in a receptacle 241. The receptacle 241 has a corresponding shape and is, in principle, designed similarly to the axle bearing depressions 40 and 140, only with a polygonal cross section. The polygonal bearing end 249 is thus seated, as it were, rotationally fixedly in the receptacle 241, and the auxiliary outlet flap 244 itself is so soft or elastic, or is composed of such elastic material, that said auxiliary outlet flap itself forms the actuating means by which it is opened, that is to say, as it were, the spring or the spring action is integrated into the flap. Rubber, for example, is expedient for this purpose. The upper, solid-line illustration in FIG. 10 shows the auxiliary outlet flap 244 in an open position with fluid flow with the direction of revolution ER as in FIG. 9 at the top. It can be clearly seen that, here, an adequately large inflow for the fluid into the auxiliary outlet opening 239 is possible. The auxiliary outlet flap 244 can in this case thus itself have and perform a sealing function through suitable material selection, because said auxiliary outlet flap, and in particular its free end, is flexible and can bear closely, in particular against the edge of the auxiliary outlet opening 239. Thus, said auxiliary outlet flap can, without additional attachment or provision of a seal, in particular of a seal composed of a different material, close the additional outlet or the auxiliary outlet opening 239. There is no need for a stepped edge to once again be provided in order that the auxiliary outlet flap 244 disappears in a flush manner and imparts a better sealing action; rather, the auxiliary outlet flap 244 can lie on the base surface 229 around the auxiliary outlet opening 239.

Shown in the dashed-line illustration at the top in FIG. 10 is a position into which the auxiliary outlet flap 244 moves of its own accord owing to its own spring force in the absence of any fluid flow. From this, it can be seen that, here, the auxiliary outlet flap 244 opens only a relatively small amount owing to its inherent spring force, that is to say, in effect, as its own actuating means. The further opening into the open position illustrated by solid lines is then realized specifically by means of the fluid flow with the direction of revolution ER, which causes said auxiliary outlet flap to be pushed open somewhat further, or bent up somewhat further.

At the bottom in FIG. 10, it is illustrated how the auxiliary outlet flap 244 closes the auxiliary outlet opening 239 in the closed position. This is illustrated here not as being as entirely smooth or flat as at the bottom in FIG. 9, because the auxiliary outlet flap 244 has a slight arch or bend. Ultimately, said auxiliary outlet flap is pushed downward from the position illustrated by dashed lines at the top in FIG. 10 by the fluid flow with the direction of revolution FR. Since an abovementioned spring force for the opening of the auxiliary outlet flap 244 or for the movement may however be relatively small, which also applies to the other described embodiments of actuating means or spring means, this can be realized in a technically effective manner.

The advantage of such an auxiliary outlet flap 244 as per FIG. 10 in relation to that of FIG. 9 lies, as is clearly evident, in that it is considerably simpler in terms of construction and in terms of assembly. Also, there is no need for parts that are potentially susceptible to corrosion, or for springs, which could break or even fail.

In a yet further embodiment of the invention, it would be possible, proceeding from FIG. 10, for an auxiliary outlet flap of relatively rigid form to have a polygonal bearing end, which is partially encased in resiliently elastic fashion and then rotates, as it were, in the receptacle counter to said spring elasticity. It is thus possible, for example, for a bearing end of polygonal form to be surrounded by a layer of relatively soft plastic or foamed material and to be rotated counter to the spring elasticity thereof into the closed position by a relatively intense fluid flow with the direction of revolution FR. When said fluid flow stops, the resiliently elastic plastic can push the auxiliary outlet flap 244 open.

The invention claimed is:

1. An impeller pump having a pump chamber with an inlet into said pump chamber, and with an outlet out of said pump chamber, an impeller in said pump chamber, a direction of rotation of said impeller for pumping fluid from said inlet to said outlet, wherein an auxiliary outlet out of said pump chamber together with an auxiliary outlet flap is provided, wherein said auxiliary outlet flap:

has a closed position and at least one open position, is designed to be movable between said closed position and said at least one open position, in said closed position, closes off said auxiliary outlet and, in each of said open positions, at least partially opens up or opens said auxiliary outlet, has an actuating means and is subjected to force loading by said actuating means such that said auxiliary outlet flap is moved automatically from said closed position into one of said open positions if said auxiliary outlet flap is free from fluid flow in said direction of rotation of said impeller for pumping fluid from said inlet to said outlet.

2. The impeller pump according to claim 1, wherein said auxiliary outlet flap is moved by said actuating means into that open position of said multiple open positions which has a maximum degree of opening or in which said auxiliary outlet flap is at a maximum distance from said closed position.

3. The impeller pump according to claim 1, wherein said impeller pump has spring means as actuating means for subjecting said auxiliary outlet flap to force loading for said movement.

4. The impeller pump according to claim 3, wherein said spring means are made from plastics.

5. The impeller pump according to claim 3, wherein said spring means comprises a voluminous block body.

6. The impeller pump according to claim 3, wherein said spring means is selected from the following group: leaf spring, helical spring, spiral spring and helical-spiral spring.

7. The impeller pump according to claim 1, wherein said pump has sealing means at said auxiliary outlet or at said auxiliary outlet flap.

8. The impeller pump according to claim 7, wherein said sealing means is injection-molded onto said pump housing in a multi-component injection molding process.

9. The impeller pump according to claim 7, wherein said sealing means comprise a sealing rubber.

10. The impeller pump according to claim 7, wherein said sealing means are formed as a labyrinth seal with a stepped profile of a sealing surface between said auxiliary outlet and said auxiliary outlet flap.

11. The impeller pump according to claim 1, wherein said auxiliary outlet flap, in said closed position, forms a continuous continuation of said profile of said pump chamber or of a wall of said pump chamber in a region around said auxiliary outlet.

12. The impeller pump according to claim 11, wherein said auxiliary outlet flap, in said closed position, forms a continuous continuation of said profile of said pump chamber or of a wall of said pump chamber in said region around said auxiliary outlet, with roundings and archings corresponding to said region of said pump chamber surrounding said auxiliary outlet.

13. The impeller pump according to claim 1, wherein said auxiliary outlet flap has an inner side which, in said closed position, points toward said auxiliary outlet.

14. The impeller pump according to claim 13, wherein said inner side of said auxiliary outlet flap is shaped so as to be convexly arched away from said auxiliary outlet.

15. The impeller pump according to claim 13, wherein said inner side of said auxiliary outlet flap has a lateral wall with an angle of between 60° and 120° with respect to said outer side, which lateral wall extends away from said pump chamber in said direction of said auxiliary outlet or into said auxiliary outlet.

16. The impeller pump according to claim 15, wherein, in an open position with said maximum degree of opening, said lateral wall at least partially still projects into said auxiliary outlet.

17. The impeller pump according to claim 16, wherein, in said open position with said maximum degree of opening, said lateral wall runs, over its entire length in a direction away from an axis of rotation of said auxiliary outlet flap, with a free longitudinal outer edge within said auxiliary outlet.

18. The impeller pump according to claim 15, wherein said lateral wall runs parallel to an encircling outer wall of said pump chamber.

19. The impeller pump according to claim 15, wherein, in an open position with said maximum degree of opening, said lateral wall runs with a spacing of between 0.5 cm and 2 cm to an encircling outer wall of said pump chamber.

20. The impeller pump according to claim 1, wherein said pump chamber is formed in ring-shaped fashion around said impeller, wherein said auxiliary outlet is arranged in an end surface of said pump chamber in an axial direction along said axis of rotation of said impeller.

21. The impeller pump according to claim 20, wherein said an end surface of said pump chamber runs approximately in a plane of one of two cover surfaces of said impeller.

22. The impeller pump according to claim 20, wherein, in said closed position, an outer side of said auxiliary outlet flap runs in said end surface, wherein, in an open position with said maximum degree of opening, said auxiliary outlet flap is situated close to said impeller.

23. The impeller pump according to claim 22, wherein, in said closed position, said outer side of said auxiliary outlet flap runs in a continuous fashion in said end surface of said pump chamber.

24. The impeller pump according to claim 22, wherein, in said open position with said maximum degree of opening, said auxiliary outlet flap is arranged with at most a 1 cm radial spacing to said impeller, wherein an inner side of said auxiliary outlet flap is arranged at least at an axial level of and radially outside said other cover surface of said impeller, such that fluid flows out of said impeller directly outward in a radial direction into said auxiliary outlet flap and into said auxiliary outlet.

25. The impeller pump according to claim 1, wherein said auxiliary outlet leads out of said pump chamber in a radial direction or in a plane perpendicular to an axis of rotation of said impeller.

26. The impeller pump according to claim 25, wherein said auxiliary outlet leads out of said pump chamber and out of a housing of said impeller pump.

* * * * *